United States Patent [19]

Mathijssen

[11] Patent Number: 4,481,443

[45] Date of Patent: Nov. 6, 1984

[54] SHORT-ARC DISCHARGE LAMP

[75] Inventor: Petrus J. Mathijssen, Eindhoven, Netherlands

[73] Assignee: U.S. Philips Corporation, New York, N.Y.

[21] Appl. No.: 31,647

[22] Filed: Apr. 19, 1979

[30] Foreign Application Priority Data

May 23, 1978 [NL] Netherlands ..... 7805542

[51] Int. Cl.[3] ..... H01J 63/30

[52] U.S. Cl. ..... 313/636

[58] Field of Search ..... 313/221, 636

[56] References Cited

U.S. PATENT DOCUMENTS

| | | | |
|---|---|---|---|
| 2,060,043 | 4/1936 | Cox | 313/221 X |
| 3,564,328 | 2/1971 | Bagley et al. | 313/221 X |
| 4,091,951 | 5/1978 | Zijlstra et al. | 313/221 X |
| 4,104,418 | 8/1978 | Park et al. | 313/221 X |

FOREIGN PATENT DOCUMENTS

| | | | |
|---|---|---|---|
| 1132242 | 7/1962 | Fed. Rep. of Germany | 313/221 |
| 431450 | 6/1935 | United Kingdom | 313/221 |
| 456642 | 11/1936 | United Kingdom | 313/221 |

*Primary Examiner*—David K. Moore

*Attorney, Agent, or Firm*—Robert S. Smith

[57] ABSTRACT

A short-arc discharge lamp having tungsten electrodes, tungsten electrode pins, and a sealed vacuum-tight lamp envelope filled with a rare gas. Hitherto the electrode pins have been sealed into neck-shaped portions of the envelope using graded seals. In a lamp according to the invention, the electrode pins extend through neck-shaped portions of the envelope. In the vicinity of the respective envelope to electrode pin seal, the electrode pin bears a local glass coating. An annular glass bead-shaped member is sealed to this glass coating and the neck-shaped portion is sealed to at least part of the length (in the direction of the longitudinal axis of the electrode pin) of the bead-shaped member. The glass coating and the bead-shaped member each have a coefficient of thermal expansion with in the range from 11 to $17\times10^{-7}$ per deg C.

2 Claims, 9 Drawing Figures

SHORT-ARC DISCHARGE LAMP

The invention relates to a short-arc discharge lamp having a sealed vacuum-tight quartz glass lamp envelope filled with a rare gas and comprising a lamp envelope portion which encloses the discharge space and two neck-shaped portions through each of which a tungsten electrode pin which supports a respective tungsten electrode. Each electrode pin has locally a circumferential glass coating and an annular glass number is sealed to the coating between the ends of the coating, the annular glass member is connected to the quartz glass of the relevant neck-shaped portion.

Such a short-arc discharge lamp (compact source lamp) is known from FIG. 1*d* of German Patent Specification No. 1,132,242.

Because of the high temperatures prevailing in a short-arc discharge lamp during operation, the lamp envelope is usually manufactured from quartz glass, while the electrodes and the electrode pins are manufactured from tungsten. These materials have such different coefficients of thermal expansion (quartz glass approximately $7\times10^{-7}/\text{deg}^{C}$, tungsten approximately $45\times10^{-7}/\text{deg}^{C}$) that special measures have to be taken to make it possible to lead the electrode pins through the wall of the lamp envelope in a vacuum-tight manner. A construction is used in commercially available lamps which is also shown in the the German Patent Specification (FIG. 1*b*). This construction is very complicated and its manufacture requires a high skill.

Although the construction described in the first paragraph of the present specification is simpler, the abovementioned German Patent Specification states that this simpler construction is only suitable for lamps having a medium gas pressure. In this simpler construction, the glass coating of the electrode pin, as well as the annular glass member sealed thereto, consists of a glass which has the same coefficient of thermal expansion as tungsten. The part of the annular glass member extending from the coating is formed into a tube which is sealed to a tube of transition glasses which in turn is sealed to a quartz glass tube which forms a neck-shaped portion of the lamp envelope. The thickness of the annular glass member and the diameter of the tube formed from the annular glass member correspond to the thickness and the diameter of the quartz glass tube constituting the neck portion.

It is the object of the invention to provide a short-arc discharge lamp of a very simple construction which is suitable to be filled with glass up to high pressures.

A short-arc discharge lamp according to the invention is characterized in that the annular glass members are annular glass bead-shaped members, the glass coating on the electrode pins and the annular glass bead-shaped members sealed thereto each have a coefficient of thermal expansion within the range from 11 to $17\times10^{-7}$ per $\text{deg}^{C}$ in the range from 30° to 800° C., that each neck-shaped portion surrounds the respective annular glass bead-shaped member over at least a part of its surface remote from the discharge space and is directly sealed to said member.

In contrast with the known lamp described in German Patent Specification No. 1,132,242 in the lamp according to the invention a glass is used for the coating of the electrode pin and for the annular bead-shaped member, which glass has a coefficient of thermal expansion which does not correspond to that of tungsten but is close to that of quartz glass. Hence additional intermediate glasses need not be used to seal the annular glass bead-shaped member to the neck portion in a lamp according to the invention.

The construction of the lamp according to the invention is simple and hence the manufacture of the lamp is easily realized.

A further advantage of the lamp according to the invention is that the location where the electrode pin is sealed into glass, the overall length of the lamp being the same, is more remote from the electrodes and is hence exposed to less high temperatures than is the case in the said existing commercial lamps. Moreover, in the lamp according to the invention, this location is directly surrounded by the open air, whereas in the commercial lamps it is substantially screened therefrom (by the quartz glass 8 in FIG. 2). This makes it possible to make shorter lamps than similar commercial lamps.

A lower temperature of the part of the electrode pin which is in contact with the air is of significance because oxidation of the pin is less when the temperature decreases. In fact, oxidation may give rise to the crumbling away of the glass coating on the pin, which may result in cracking of the seal. It is therefore of importance for the temperature of the electrode pin outside the lamp envelope to be below approximately 550° C.

The glass bead-shaped member generally has a largest diameter which approximately corresponds to the inside diameter of the neck-shaped lamp envelope portion.

Short-arc discharge lamps generally have electrode pins of at least 1 mm diameter. The glass coating on an electrode pin is preferably made as thin as possible, generally in a thickness of at most half of the diameter of the electrode pin.

In one embodiment of the invention, the annular glass bead-shaped member is conical on its side remote from the discharge space, the relevant neck-shaped portion surrounds the greater part of the conical surface of the annular glass bead shaped member and is sealed thereto.

With a view to the differences in coefficients of thermal expansion of tungsten and of quartz glass stresses in the glass also occur in lamps according to the invention. However, as a result of the geometry chosen, in which the glass bead-shaped member is enclosed by the quartz glass of the neck-shaped lamp envelope portion, these are pressure stresses which are taken up by the quartz glass.

Quartz glass is to be understood to mean herein fused silicon dioxide and glass having a silicon dioxide content of at least 95% by weight, for example "Vycor" (Trade Mark). The glasses which are fused for coating the electrode pin and for constituting the annular glass bead-shaped member have a significantly lower silicon dioxide content, generally between 81 and 87% by weight. Furthermore, these glasses comprise approximately 9–13.5% by weight of $B_2O_3$, approximately 4–7.5% by weight of $Al_2O_3$ and 0–1% by weight of CaO.

The lamp according to the invention may be used, for example, for film projection.

Some embodiments of a lamp according to the invention will now be described with reference to the drawings, in which.

Figure 4:
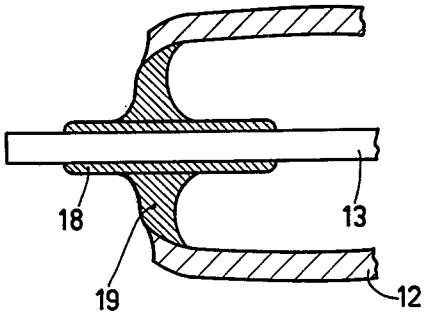
FIG. 4 is a sectional view of a detail of the lamp shown in FIG. 3.
Figure 7A:
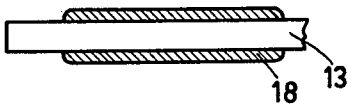
Figure 7B:
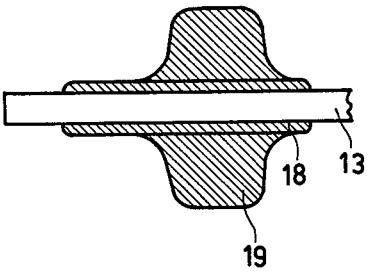
Figure 7C:
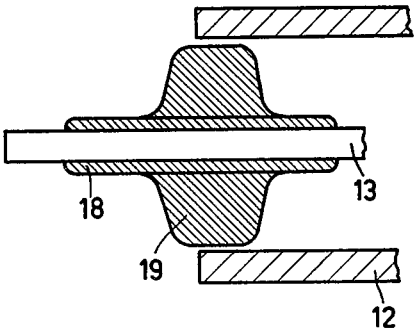

FIG. 7*a*, 7*b* and 7*c* shows stages in the manufacture of the seal shown in FIG. 4.

Figure 1:
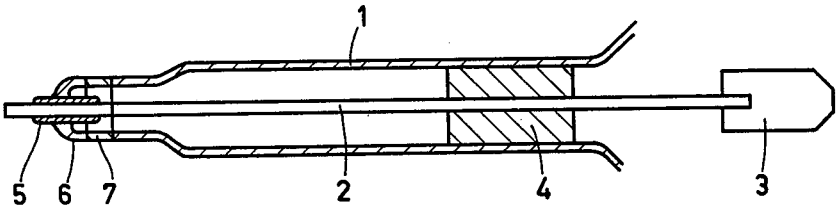
Fig.1 PRIOR ART
FIG. 1 is a longitudinal section of part of a known short-arc discharge lamp.

FIG. 1 shows the lead through construction of a known short-arc discharge lamp which is suitable for medium pressures. An electrode pin 2 extends through a quartz glass neck-shaped portion 1 of a lamp envelope to an electrode 3. The electrode pin 2 is surrounded by a support 4 which bears against the wall of the neck-shaped portion 1. A glass coating 5 is present on the electrode pin 2 and an annular glass member 6 is sealed to the coating 5, both the coating 5 and the member 6 consist of a glass having a coefficient of thermal expansion equal to that of tungsten. The annular glass member 6 is sealed to the neck-shaped portion 1 of the lamp envelope through a graded seal 7.

Figure 2:
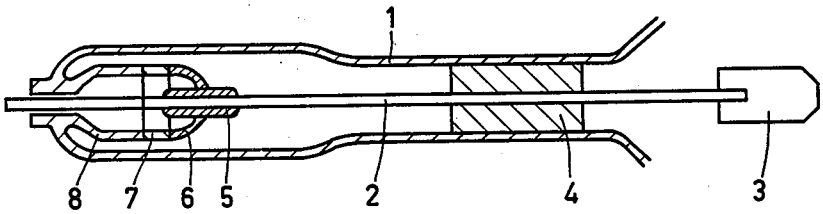
Fig. 2 PRIOR ART
FIG. 2 is a longitudinal section part of another known short-arc discharge lamp.

FIG. 2 shows the lead through construction of a conventional commercially available short-arc discharge lamp. Reference numerals 1 to 7 denote parts which correspond to parts shown in FIG. 1 having the same reference. In FIG. 2 the annular glass member 6 is directed away from the electrode 3. The annular glass member 6 is connected through a graded seal 7, to a tubular quartz glass part 8 which surrounds the electrode pin 2 with some clearance and is sealed to the neck-shaped portion 1 of the lamp envelope.

Figure 3:
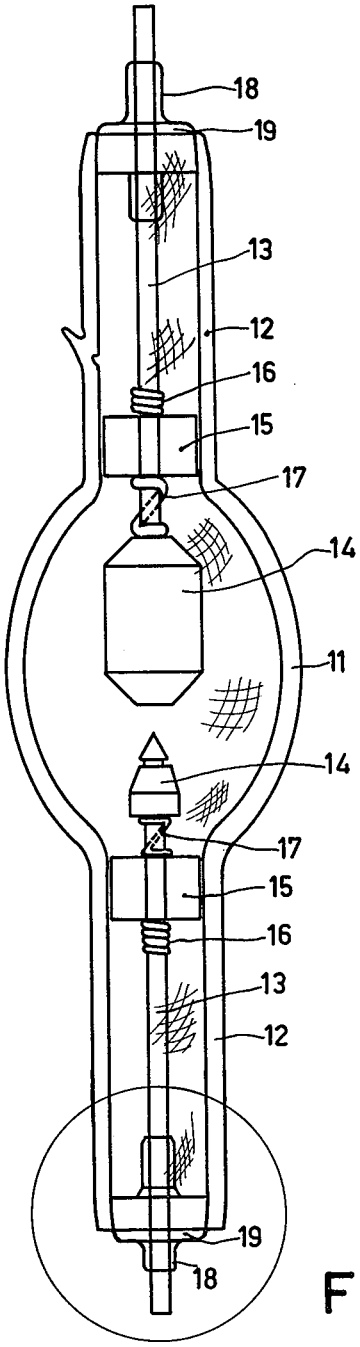
FIG. 3 is a side elevation of a short-arc discharge lamp according to the invention.

FIG. 3 shows a short arc discharge lamp according to the invention. A part 11 of the lamp envelope which surrounds the discharge space adjoins two neck-shaped portions 12 of the lamp envelope. An electrode pin 13 extends through each of the neck-shaped portions 12 towards an electrode 14 accommodated in the discharge space. For supporting purposes the electrode pins 13 are each surrounded by a quartz glass cylinder 15 secured between a tungsten wire coil 16 which clamps around the pin 13, and a separator 17 of tungsten wire. A local circumferential glass coating 18 is present on each electrode pin 13 and an annular glass bead-shaped member 19 is sealed to the glass coating 18. Each neck-shaped portion 12 of the lamp envelope surrounds part of the length (extending in the length direction of the electrode pin 13) of a bead-shaped member 19 and is sealed thereto.

Figure 5:
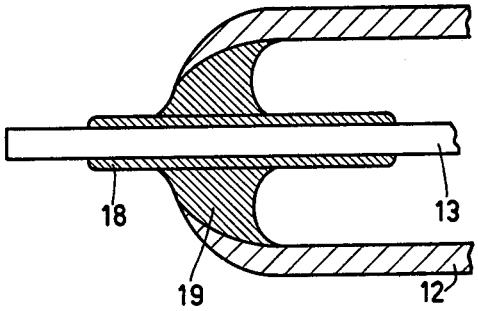
FIG. 5 shows a first modified embodiment of FIG. 4.
Figure 6:
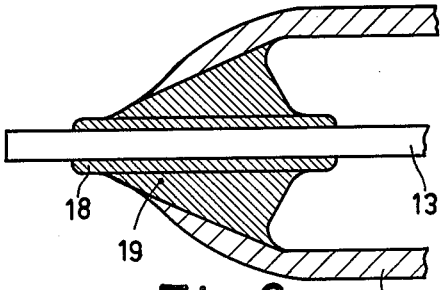
FIG. 6 shows a second modified embodiment of FIG. 4.

The reference numerals in FIGS. 4 to 6, 7*a*, 7*b* and 7*c* denote the same parts as parts shown in FIG. 3 having the same reference numerals. In FIGS. 5 and 6, the neck-shaped portions 12 of the lamp envelope surround greater proportions of the lengths of the bead-shaped members 19 than in FIG. 4. The surface of the bead-shaped member 19 remote from the electrode 14 is conical in FIGS. 5 and 6. It is to be noted that upon making the seal of the quartz glass of the neck-shaped portion 12 to the glass of the bead-shaped member 19, the demarcation between the types of glass becomes indistinct and an area is formed in which one glass merges into the other.

FIG. 7*a* shows the product of a first step in the manufacture of the seal in which a coating 13 is formed from a glass rod on a tungsten electrode pin 13 while heating.

FIG. 7*b* shows the product of a second step in which an annular glass bead-shaped member has been sealed to the coating by heating.

FIG. 7*c* shows the product of FIG. 7*b* in position adjacent to a neck portion 12 before sealing. Upon making said seal, the assembly is preferably placed with its longitudinal axis in the horizontal position. The quartz glass of neck portion 12 is heated by means of a flame and press inwardly by the flame, and contacts with the bead-shaped member 19. The material of the bead-shaped member is indirectly heated for the greater part, by radiation emitted by the neck portion 12. Upon making the seal, some tool may be used to press the quartz glass inwardly. By blowing gas into the tube 12, a gradual transition of the surfaces of the sealed parts is obtained. The shape of the outer surface of the product is determined for the greater part by the length over which the bead-shaped member 19 in FIG. 7*c* is introduced into the neck-shaped portion 12 and the shape and the position of any tool with which the neck-shaped portion 12 is pressed inwardly at its end, if such a tool is used.

The manufacture of the seals is not very critical. Lamps having the geometry of any of those shown in FIGS. 4 to 6 at the ends of the neck-shaped portion 12 of the lamp envelope were pressure-tested at room temperature at 120 bar without any cracks occurring.

It is to be noted that said test performed at room temperature is more stringent and hence more reliable than a similar test performed at the operating temperature. There are no stresses at the high temperatures at which the glass-to-glass seals and the glass-to-metal seals have been made. These only appear below the stress-build up temperature upon cooling the product and become large according as the temperature decreases further. At room temperature at which the pressure resistance of the lamp was tested, the stresses of the material are hence larger than at the operating temperature of the lamp which is less far below the stress-build up temperature. In lamps constructed in the geometry of FIG. 1 while using the same materials but without using a graded seal 7*a*, crack occurred at a pressure of 40 bar.

EXAMPLE

For the manufacture of the lamp shown in FIG. 3, electrode pins 13 of 2.5 mm diameter were used coated with a 0.5 mm thick coating 18 of a glass having the following composition: 81.9% by weight $SiO_2$, 13.1% by weight $B_2O_3$, 4.5% by weight $Al_2O_3$ and 0.5% by weight CaO. Over the temperature range from 30°to 800° C., this glass has a coefficient of thermal expansion of $15\times10^{-7}$ per deg C. A bead-shaped member 19 of the same glass was provided thereon and having a maximum diameter of 9 mm. After assembling the supporting member 15, the coil 16, the separator 17 of tungsten wire and the electrode 14, the assembly was inserted into a lamp envelope the neck-shaped portion 12 of which had an inside diameter of 10 mm with a wall thickness of 2.5 mm. After sealing the bead-shaped member 19 to the neck-shaped portion 12, the second electrode was mounted in a similar manner. The lamp envelope was evacuated, filled with 10 bar xenon and sealed. The electrode spacing in the lamp was 2.8 mm and the lamp consumed a power of 500 watts during operation at 18 volts. The lamp was operated in the horizontal position for 2000 hours.

Other glasses which may be used for the manufacture of the coating and flange are, for example:

(1) $SiO_2$ 86.9% by weight, $B_2O_3$ 9.0% by weight, $Al_2O_3$ 4.1% by weight, coefficient of thermal expansion in the range from 30° to 800° C., $11\times10^{-7}$ per deg. C.

(2) $SiO_2$ 86.4% by weight, $B_2O_3$ 9.6% by weight, $Al_2O_3$ 4.0% by weight, coefficient of thermal expansion in the range from 30° to 800° C., $13\times10^{-7}$ per deg. C.

(3) $SiO_2$ 81.0% by weight, $B_2O_3$ 10.9% by weight, $Al_2O_3$ 7.1% by weight, CaO 1.0% by weight, coefficient of thermal expansion in the range from 30°to 800° C., $17\times10^{-7}$ per deg. C.

What is claimed is:

1. A short-arc discharge lamp having a sealed vacuum-tight quartz glass lamp envelope filled with a rare gas and comprising a lamp envelope portion which encloses the discharge base and having first and second neck-shaped portions each having an inner bore, first and second tungsten electrode pins extending respectively through said first and second neck-shaped portions, first and second tungsten electrodes supported respectively on said first and second tungsten electrode pins, each electrode pin locally having a circumferential and axially extending glass coating, first and second annular glass members sealed to said coating between the axial extremities of said coating on respectively said first and second electrode pins, said first and second annular glass members each having a circumferential surface in intimate contact with and sealed to said inner bore respectively of said first and second portions, said annular glass members each being annular glass bead-shaped members which do not extend radially beyond the extent of said inner bore cooperating therewith, said glass coating on said electrode pins and said annular glass bead-shaped member sealed thereto each having a coefficient of thermal expansion within the range of from 11 to $17\times10^{-7}$ per degree C in the range from 30°to 800° C.

2. A short-arc discharge lamp as claimed in claim 1 wherein said annular glass bead-shaped members are conically shaped and each neck-shaped portion surrounds the greater part of said conical surface of the respectively annular glass bead-shaped member and is sealed thereto.

* * * * *